US005318488A

United States Patent [19]

Babcock

[11] Patent Number: 5,318,488

[45] Date of Patent: Jun. 7, 1994

[54] WATERSKIING SIMULATOR

[75] Inventor: Michael A. Babcock, 3124 Dakota Ave. South, Minneapolis, Minn. 55416

[73] Assignee: Michael Anthony Babcock, St. Louis Park, Minn.

[21] Appl. No.: 966,558

[22] Filed: Oct. 26, 1992

[51] Int. Cl.[5] ..... A63B 69/18

[52] U.S. Cl. ..... 482/51; 482/71

[58] Field of Search ..... 482/51, 23, 33, 34, 482/55, 71, 70, 121, 127, 130, 133, 136, 147, 148

[56] References Cited

U.S. PATENT DOCUMENTS

| | | |
|---|---|---|
| 2,573,808 | 11/1951 | Ravoire . |
| 3,159,400 | 12/1964 | Brass et al. . |
| 3,374,782 | 3/1986 | Izzo . |
| 3,408,067 | 10/1968 | Armstrong . |
| 3,455,550 | 7/1969 | Hall . |
| 3,467,374 | 9/1969 | Auer . |
| 3,531,110 | 9/1970 | Marchu . |
| 3,593,994 | 7/1971 | Anbar . |
| 3,912,260 | 10/1975 | Rice . |
| 3,941,377 | 3/1976 | Lie . |
| 4,132,405 | 1/1979 | Asher . |
| 4,386,915 | 6/1983 | Gilliam . |
| 4,396,189 | 8/1983 | Jenkins . |
| 4,544,153 | 10/1985 | Babcock . |
| 4,811,941 | 3/1989 | Elo . |
| 4,907,796 | 3/1990 | Roel-Rodriguez . |
| 4,948,124 | 8/1990 | Ghaly . |
| 5,062,629 | 11/1991 | Vaughan . |

FOREIGN PATENT DOCUMENTS

| | | |
|---|---|---|
| 832295 | 6/1938 | France . |
| 481658 | 11/1969 | Switzerland . |

*Primary Examiner*—Stephen R. Crow

[57] ABSTRACT

A waterski simulator is provided comprising a platform constructed and arranged to hold one practice skier and to rotate 180° about a first pivot point, a pivoting arm constructed and arranged to rotate about 180° about a second pivot point, the pivoting arm and the platform pivoting towards each other, a handle means connected to and extending from the pivoting arm and a resisting means associated with the pivoting arm providing resistance to the rotation thereof, said resistance being overcomeable by a practicing skier, whereby the practicing skier stands on the platform facing the pivoting arm and holds the handle means thereof, alternatively pivoting the platform and the pivoting arm, thereby simulating the movements associated with waterskiing.

15 Claims, 6 Drawing Sheets

WATERSKIING SIMULATOR

BACKGROUND OF THE INVENTION

This invention relates to apparatus for exercising and practicing slalom-style waterskiing. More particularly, it is directed to an improved apparatus for use indoors or outdoors as an exercise device while also giving the experience of slalom-type waterskiing.

The apparatus of the invention has been designed to simulate the balance and muscular exertion normally experienced in slalom-style waterskiing.

The apparatus enables a practicing alder to reach or maintain the muscular condition required for aggressive waterskiing. For the skier who is unable to ski as often as necessary to advance or maintain a high level of skill and endurance, the apparatus of this invention has particular applicability.

Working out on the apparatus is much simpler than actually engaging in waterskiing as such. There is no need for a boat operator and a spotter, nor is the time and expense of obtaining and operating a ski boat required. Neither does the weather affect scheduled practice sessions since the apparatus may be set up indoors and used year round. The apparatus is also small enough to be carried through a doorway and set up outdoors.

SUMMARY OF THE INVENTION

The slalom-style waterskiing simulator apparatus is disclosed in detail hereinbelow. The apparatus includes a pivotal ski mount and a pivotally mounted swing arm which is pulled back and forth thereby placing the practicing skier through the efforts and body positions normally encountered in slalom-style siding. The swing arm is controlled by an energy storing and dispensing mechanism such as a pneumatic cylinder which functions to resist the rotation of the arm during its initial movement in one cycle, thus storing energy which is released in the form of an accelerating force applied against the arm and the latter portion of its swinging movement in completing the swing arm phase of the cycle. The pivotal ski mount is then pivoted in the opposite direction, completing the cycle. A cable locking means serves to lock the ski mount in place until completion of the swing arm phase of the next cycle, which releases the lock, allowing the ski mount to pivot. Repeated cycles simulate the maneuvers encountered during slalom-style waterskiing. The apparatus is operated solely by force exerted by the practicing skier.

DESCRIPTION OF THE PREFERRED EMBODIMENT

Figure 1:
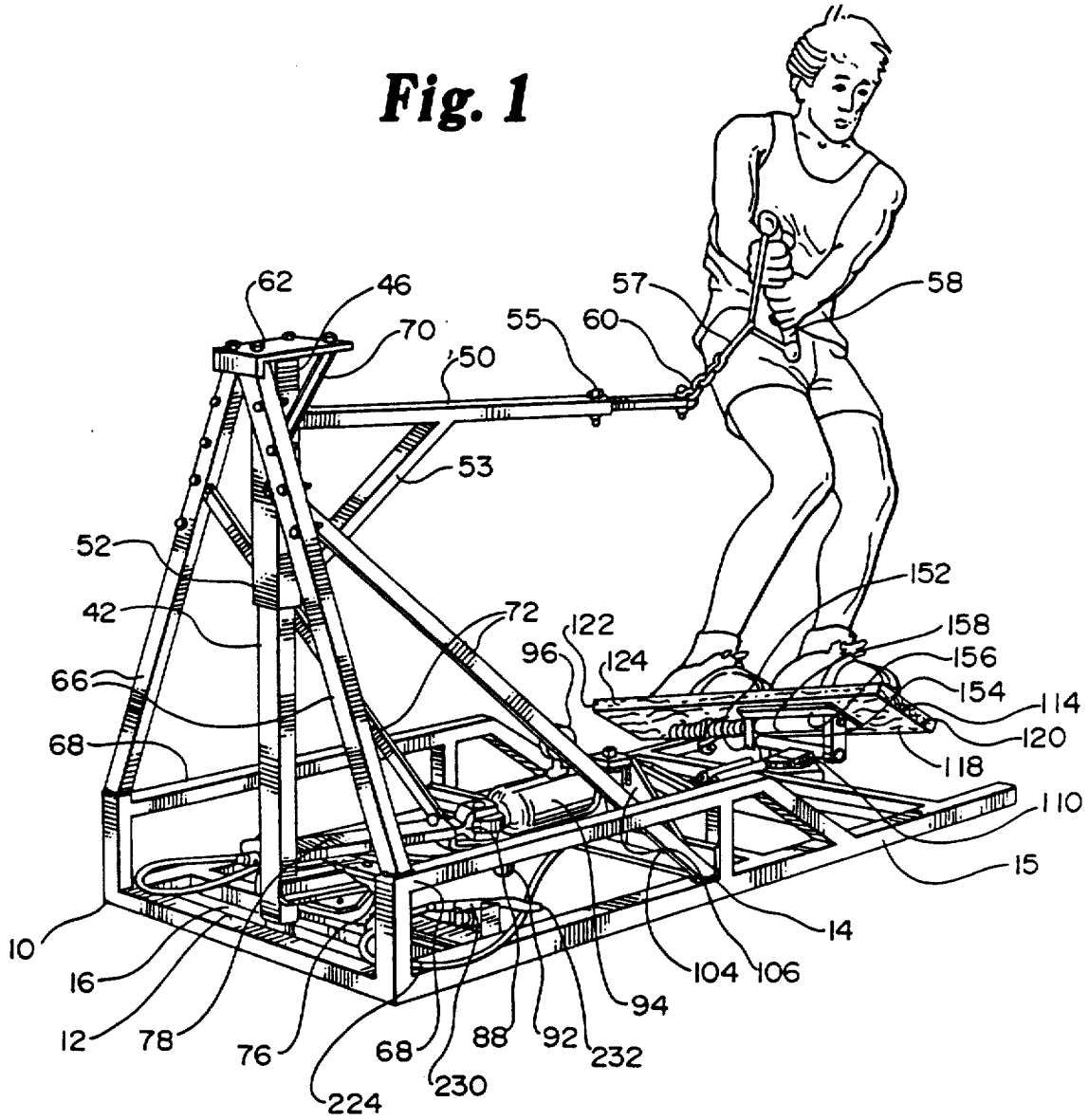
FIG. 1 is a perspective view of the apparatus of the invention including a human figure or practicing skier on the ski mount of the apparatus to illustrate the functional use of the apparatus.
Figure 8:
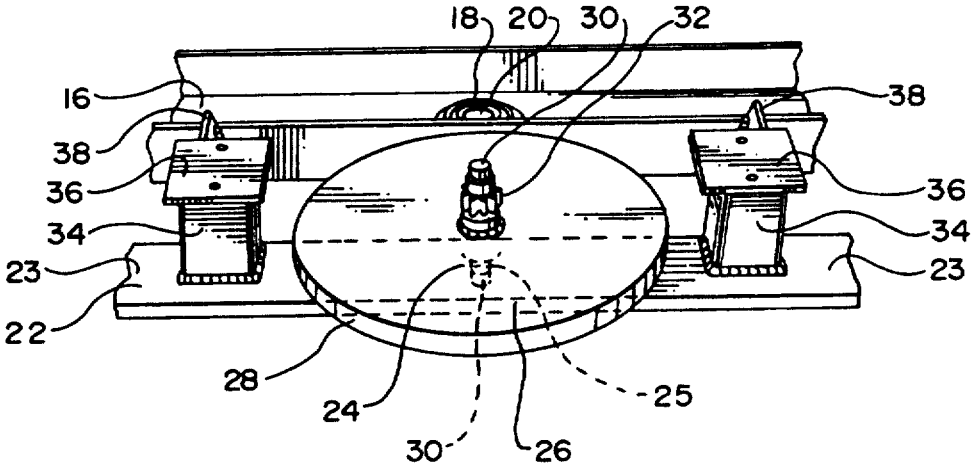
FIG. 8 is a detail perspective view thereof showing swing flywheel subassembly with parts removed.

Referring to FIG. 1, the apparatus of the invention comprises a stationary base portion 10 with a front end region 12, a central region 14 and a rear end region 15. As shown in FIG. 8, a forward cross member 16 is located proximal to front end region 12. At the midpoint 18 of cross member 16 is a pivot bearing 20. Flywheel cross plate 22 has two opposite ends 23 and a center 24. Flywheel bearing 25, shown in phantom in FIG. 8, is located at center 24 of flywheel cross plate 22, flywheel 28 being pivotally mounted in flywheel bearing 25 by means of flywheel pivot 30. Pinion 32 is mounted to flywheel pivot 30, on top of flywheel 28. Stand offs 34 are located one adjacent each opposite end 23 of cross plate 22. Cap plates 36 are located on top of stand offs 34. Flywheel cross plate 22 is parallel to forward cross member 16 and joined thereto by means of tie braces 38 extending from cross member 16 to stand offs 34.

Figure 7:
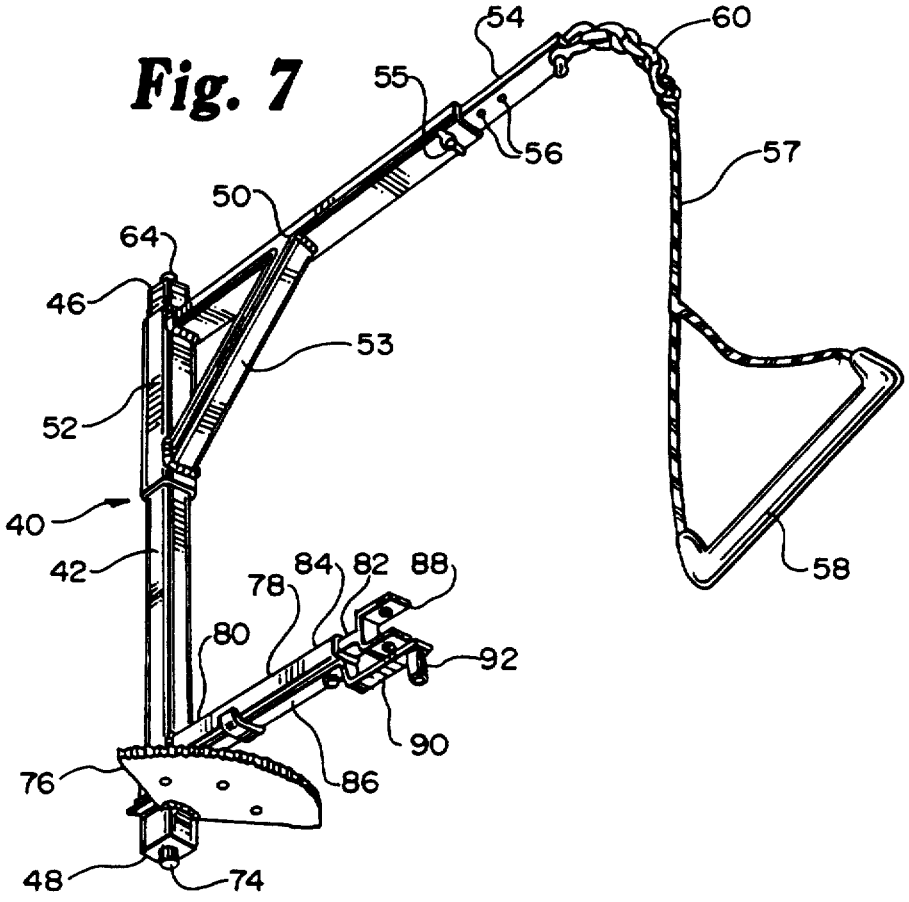
FIG. 7 is a detail perspective view thereof showing swing subassembly.

Referring now to FIG. 7, the swing assembly, indicated generally at 40, is comprised of a swing shank 42 having a head 46 and a foot 48. Swing arm 50 is connected to and extends from sleeve 52 which is mounted on swing shank 42, supporting swing arm 50 at a predetermined height above base 10, as shown in FIG. 1. Swing brace 53 extends between swing arm 50 and sleeve 52, holding swing arm 50 in position 90° from swing shank 42. Extension 54 is provided in the most preferred embodiment as shown, although swing arm 50 need not be adjustable. Extension 54 is attached to swing arm 50 by means of wing-nut and bolt assembly 55, which extends though one of several spaced adjustment holes 56. Attached to extension 54 is a ski tow 57 and handle means 58 by which a practice skier shown in FIG. 1 may exert force on swing arm 50 to cause its rotation from one extreme position to another. In the most preferred embodiment, ski tow 57 is attached to extension 54 by means of chain 60, although ski tow 57 may be attached directly to extension 54.

As shown in FIG. 1, swing shank head 46 is mounted to capital 62 by means of upper pivot pin 64 extending from head 46, shown in FIG. 7. Two side stay braces 66 extend from capital 62 to upright side supports 68 of base 10. Capital braces 70 extend from capital 62 to side stay braces 66. Angle braces 72 extend from central portion 15 of base 10 to side stay braces 66. Braces 66, 70, and 72 serve to support the structure of the apparatus.

Figure 9:
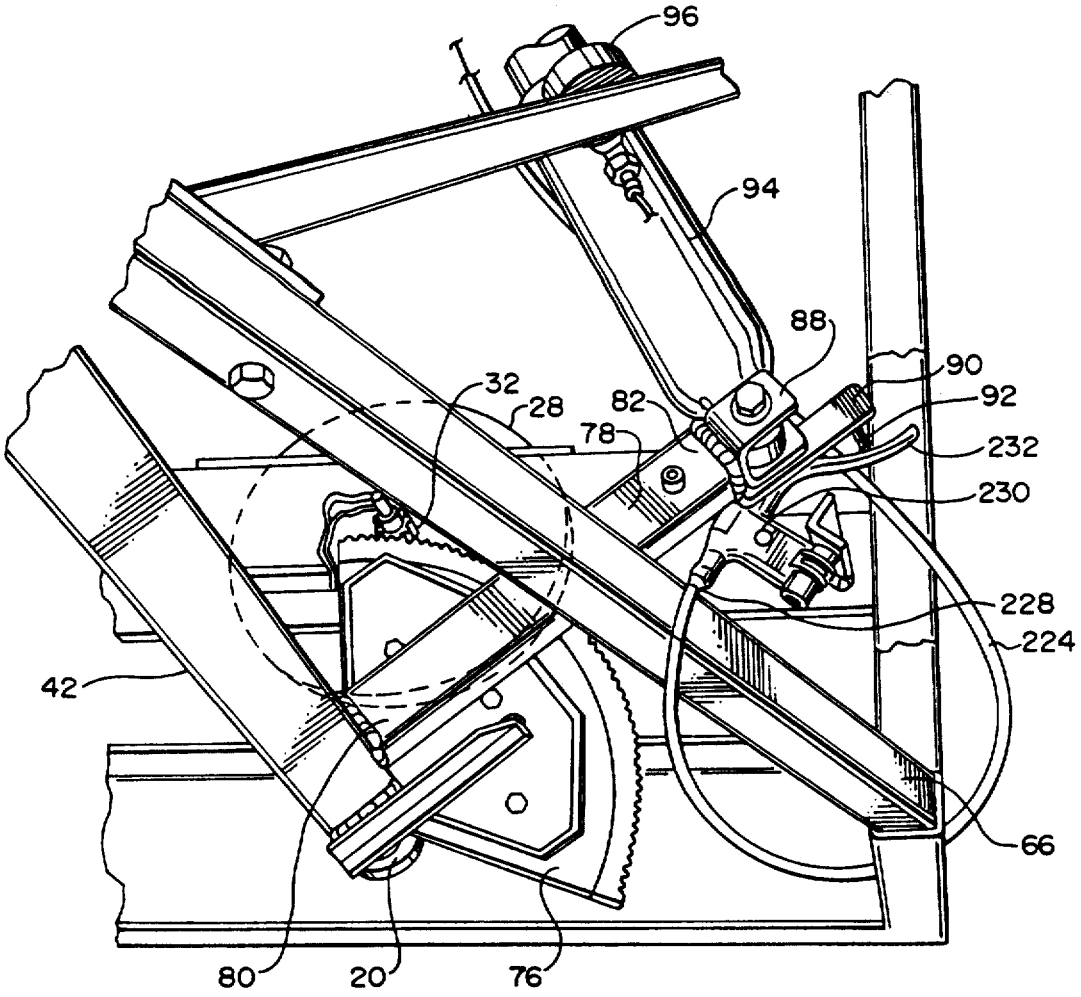
FIG. 9 is a fragmentary perspective view thereof showing swing flywheel mechanical function and extreme left position of swing lever and plunger actuator.

FIGS. 1 and 9 show swing assembly 40 pivotally mounted. Foot 48 of swing shank 42 is pivotally mounted into pivot bearing 20 by means of lower pivot pin 74, located at foot 48 of swing shank 42, as is best shown in FIG. 7. Arcuate rack 76, as shown in FIGS. 7 and 9, is mounted to swing shank 42 adjacent foot 48, and is constructed and arranged to mate with pinion 32 of flywheel 28, such that swing assembly 40 may rotate in a horizontal plane between two extreme positions.

Referring again to FIG. 7, swing lever 78, having proximal and distal ends 80, 82, a top side 84 and an underside 86, extends from swing shank 42 above arcuate rack 76. Clevis 88 extends from distal end 82 of swing lever 78. Lever finger bracket 90 is attached to underside 86 of swing lever 78. Lever finger 92 extends downwardly from lever finger bracket 90.

Figure 2:
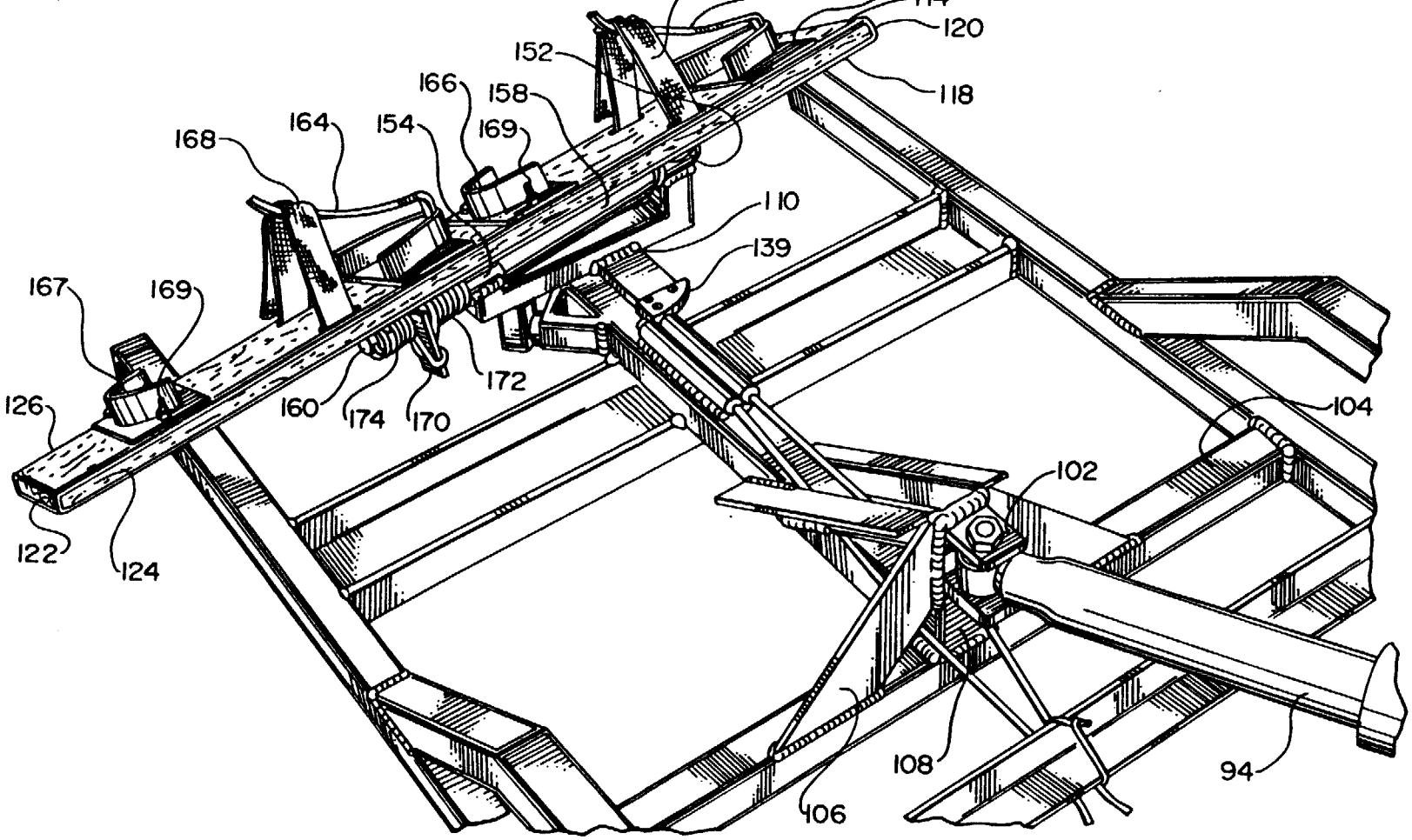
FIG. 2 is a fragmentary perspective view of the rear portion of the apparatus of FIG. 1.

As shown in FIGS. 1 and 9, swing lever 78 is connected to a resisting means 94. Resisting means 94 may be any energy-storing and releasing mechanism such as an automobile air shock absorber, fluid actuated cylinder or spring-type device. In the most preferred embodiment shown, resisting means 94 is a hydraulically dampened pneumatic cylinder. The amount of resistance which the operating skier must overcome is adjusted by adjusting the amount of air pressure added to the pneumatic cylinder at gauge 96. For illustration, a Rockhill TM #49155 air shock absorber distributed by Bumper to Bumper Program may be used. In the most preferred embodiment, the shock absorber is modified for use by removing a portion of its hydraulic fluid. Other orientations and locations of resisting means 94 and the fixed point of attachment provided by arm swing lever 78 may be utilized, although the orientation shown in the figures is most preferred. Referring to FIG. 2, resisting means 94 is connected at its other end to base clevis 102, which is attached to cross tree 104 located at the central portion 14 of base 10. A-frame 106 and base post 108 extend from cross tree 104. Base clevis 102 extends from A-frame 106 at the point where A-frame 106 and base post 108 are joined.

Figure 3:
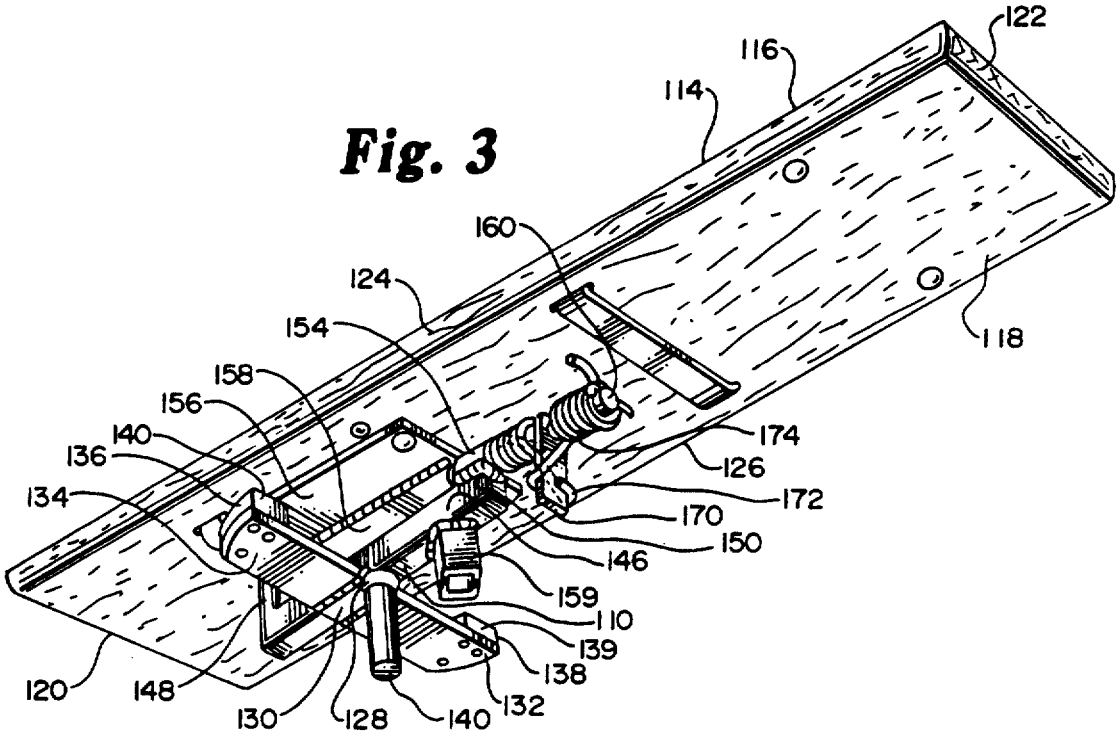
FIG. 3 is a detail perspective view thereof showing the sub assembly of the ski portion of the apparatus.
Figure 4:
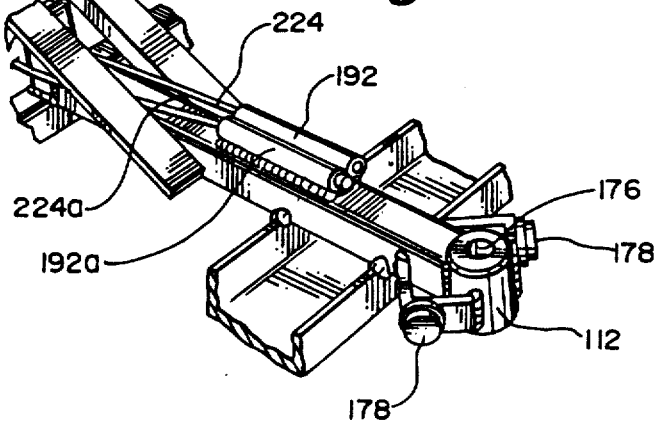
FIG. 4 is a fragmentary detail perspective view thereof showing the ski mount assembly.

Referring now to FIGS. 3 and 4, ski board assembly 110 and pivotal ski mount 112 will be described in more detail. Ski board 114 has upper and lower surfaces 116, 118, front and rear ends 120, 122, and two sides 124, 126. Lower surface 116 is not visible in FIG. 3. Pivoting means 128 extends from lower surface 118 of board 114, proximal to the rear end 122 thereof. Pivoting means 128 includes a horizontal support member 130 having two ends 132, 134, a right wing 136 and a left wing 138, each wing having a strike 139 located thereon. A depending central arm or pintle 140 extends from pivoting means 128.

Extending upwardly from horizontal support 130 is U-shaped bar 146 with a pair of spaced upright arms 148 and 150, 148 being of greater length than 150 to provide an inclined support arrangement including sockets 152 and 154 (best seen in FIGS. 1 and 2), sockets 152 and 154 being at either end of support plate 156. Roll axle housing 158 is fixed to support plate, roll axle 160 being pinned into sockets 152,154, between which roll axle housing 158 extends. Brace 159 depends from U-shaped bar 146. Roll Axle housing 158 contains bronze bushings which allow pivoting on roll axle 160.

Attached to ski 114 by any suitable mounting arrangement is a skier support means shown in FIG. 2 which includes front and rear foot stirrups 162,164, which each include a heel supports 166,167. In the preferred embodiment, as shown, stirrups 162,164 are fixed to ski 114 by straps 168, and bolt assemblies 169, although the stirrups may alternatively be molded into ski 114.

The pivotal mounting of roll axle 160 in roll axle housing 158 allows for a rocking motion of the mounting assembly 112 including the ski 114 and a practicing skier mounted thereon to simulate the rocking motion experienced under actual siding conditions. This motion is dampened controlled by means of axle lever 170 as shown best in FIG. 3, which is connected to a pair of springs, right roll return spring 172 and left roll return spring 174 which are tensioned against ski 114 and axle lever 170 to dampen the rocking motion as desired. Illustratively, springs 172,174 may be torque type springs made of 0.192 music wire having a wind of ¾ inch in I.D. (ends to center) and with 7 coils, 1.5 inches long.

Referring now to FIG. 4, pivotal ski mount 112 is located at rear end 15 of base 10, and includes a ski board gudgeon 176 which supports ski board 114 in a rotational manner to allow the practicing skier to rotate through approximately 180° from the one extreme position shown in FIGS. 1 and 2 to a second extreme position in which the skier is pointing in a reverse direction. Pintle 140 is rotatably received in ski board gudgeon 176. Brace 159 depends from U-shaped bar 146 to allow its against stops 178 which are carried by pivotal ski mount 112. Stops 178 and brace 159 Emit the rotational movement of ski board assembly 110 to approximately 180°.

Figure 5:
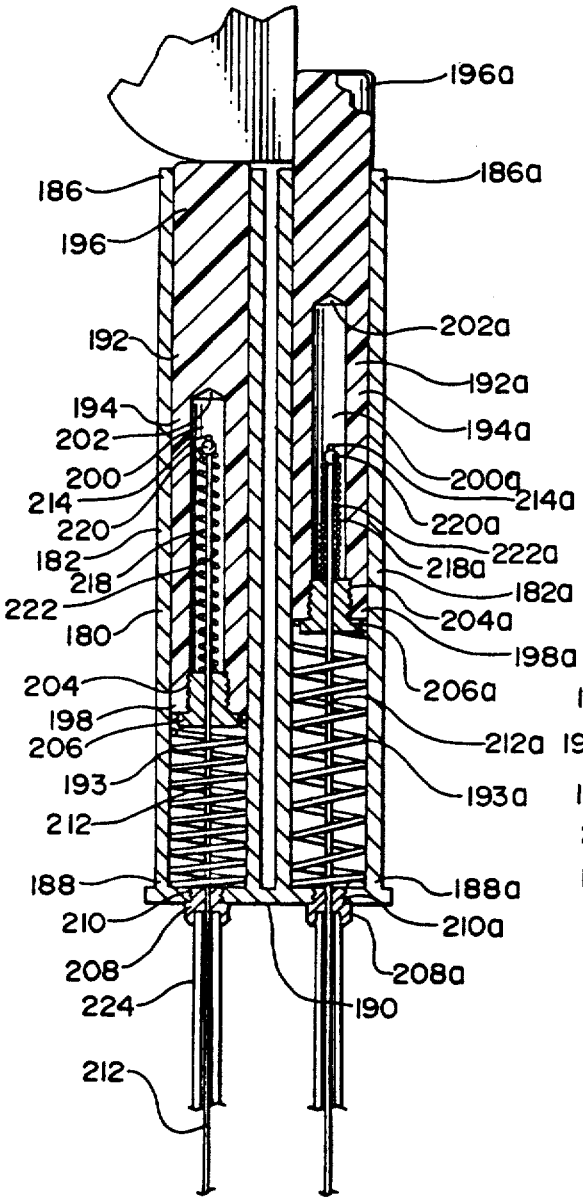
FIG. 5 is a fragmentary top plan detail view thereof showing plunger assemblies.
Figure 6:
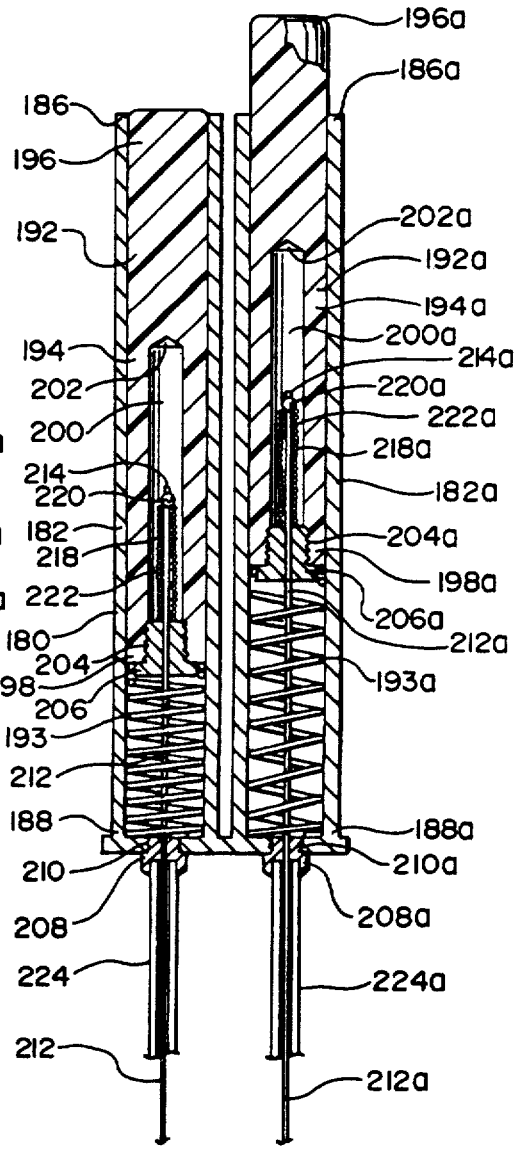
FIG. 6 is a view similar to that of FIG. 5 showing secondary position.

The present invention further includes a locking means by which the pivotal movement of the ski board assembly is controlled. Referring now to FIGS. 5 and 6, lock pin assembly 180 is shown, the purpose of which is to control the rotation of pivotal ski mount 112 and ski board 114, Lock pin assembly 180 includes a pair of tubular housings, one right 182 and one left 182*a*, each having proximal and distal ends 186, 188. Right and left housings 182 and 182*a* are joined at distal ends 188 by bulk head 190. Right plunger assembly 192 and left plunger assembly 192*a* are structurally and functionally identical, so the structure and components of right plunger assembly 192 will be described. The components of left plunger assembly 192*a* are designated in the Figures by like numerals to those of right plunger assembly 192, with the added suffix "a".

Right plunger assembly 192 is spring-loaded into housing 182 by means of strong primary spring 193. Primary spring 193 is Plunger assembly 192 includes a plunger 194 with proximal and distal ends 196, 198, and a bore 200 having a proximal end 202 and a threaded distal end 204. Threaded bore plug 206 is constructed and arranged to fit into distal end 204 of bore 200. Threaded cable fitting 208 is located at the distal end 188 of housing 182 and is adapted to mate with threaded housing opening 210.

Cable 212 has proximal and distal ends 214 and 216, proximal end 214 being spring-loaded into bore 200 of plunger 194 by means of weak secondary spring 218. For illustration, secondary spring 218 may typically be a compression spring made of 0.010 music wire having an I.D. of ⅛ inches and 20 coils, 1" in length. Swadge ball 220 is fixed to cable 212 at its proximal end 214. Cable 212 runs through interior 222 of secondary spring 218, secondary spring 218 being held in place in bore 200 between swadge ball 220 and threaded bore plug 206, the diameter of swadge ball 220 being larger than that of interior 222 of secondary spring 218.

Plunger assembly 192 is spring loaded into tubular housing 182 by means of primary spring 193 loaded between cable fitting 208 and threaded bore plug 206. For illustration, primary spring 193 may typically be a compression spring made of 0.050 music wire having an I.D. of ⅜ inches and 14 coils, 3" in length. Cable 212 runs through tubular housing 182, exiting at distal end 188 through cable fitting 208. Cable housing 224 covers cable 212, proximal end 226 of cable housing 224 being adapted to fit into cable fitting 208. As shown in FIG. 9, cable 212 and cable housing 224 are connected at distal ends 216,228 thereof to lock release mechanism 230.

FIG. 1 shows the apparatus in use. Swing assembly 40 is slightly beyond the midpoint of its clockwise rotation, as can be seen by the position of resisting means 94 almost parallel to upright sides 68 of base 10.

The rotation of swing assembly 40 is accomplished as follows. Referring to FIG. 1, rotation of swing assembly 40 is commenced by effort of the practice skier. Arcuate rack 76 of swing assembly 40 is mated with flywheel 28 by pinion 32, allowing swing assembly 40 to smoothly pivot in pivot bearing 20 in a horizontal plane between two extreme positions. Swing lever 78 of swing assembly 40 is attached at its distal end via clevis 88 to resisting means 94, which provides resistance at the beginning of the rotation and provides increased force at the end of the rotation, thereby simulating the actual force required in waterskiing.

In the phase of the operating cycle shown in FIG. 1, resisting means 94 is compressed but is pushing in a straight, vertical direction as swing assembly 40 has rotated to an intermediate position halfway through its 130° rotation. No work is required to hold swing assembly 40 in this center position between the two extreme positions of the swing arm's rotation. When using the machine, the, momentum of flywheel 28 transfers to swing assembly 40 continuing the forward motion and, as the center position shown in FIG. 1 is crossed, resisting means 94 begins to tilt and provide a sideward pushing effort against swing lever 78 of swing assembly 40. The practicing skier continues to pull on tow handle 58 to slow down the travel imparted by this action of resisting means 94 and flywheel 28.

Lever finger 92 extends downwardly from swing lever 78. As a rotation of swing assembly 40 is completed, lock release lever 232 of lock release mechanism 230 is depressed by lever finger 92 of swing assembly 40, as shown in detail in FIG. 9. Depression of lock release lever 232 causes cable 212 to be pulled distally, compressing secondary spring 218 distally, as shown in FIG. 6. As secondary spring 218 is compressed, the tension holding left wing 138 and left strike 139 is released sufficiently to free left wing 138 and left strike 139, enabling the practice skier to pivot the ski board assembly 110 in pivotal mount 112 in the clockwise direction.

As left wing 138 begins its rotation, primary spring 193 is allowed to decompress, forcing plunger assembly 192 upward and recompressing secondary spring 218, reestablishing tension in cable 212. As ski board assembly 110 completes its clockwise rotation, brace 159 meets stop 178 of pivotal mount 112, and right wing 136 and right strike 139 engage left plunger assembly 192 in the same manner in which left wing 138 and left strike 139 interact with right plunger assembly, as described above. Ski board assembly 110 is thereby locked in position until its release in response to completion of the subsequent counterclockwise rotation of swing assembly 40. The cycle is then repeated but in the reverse direction for any desired practice time.

It can be seen that the apparatus of the invention provides a simple self-emergized slalom skiing simulator which can be readily fabricated from standard structural materials such as stock metal, pipe and the like. As already indicated, resisting means 94 is preferably a hydraulically dampened pneumatic cylinder of the auto air shock-type which has been modified by removing some of its fluid to lessen its dampening ability.

The preferred embodiment of the apparatus of the invention has been illustrated and described hereinabove. However, it is to be understood that the invention is susceptible of many modifications which will fall within the spirit and scope of the appended claims.

What is claimed is:

1. A waterski simulator comprising:

(a) a platform constructed and arranged to hold one practice skier and to rotate 180° about a first pivot point;

(b) a pivoting arm constructed and arranged to rotate about 130° about a second pivot point independent of the first pivot axis;

(c) a handle means having means flexibly connected to and extending from the pivoting arm; and (d) a resisting means associated with the pivoting arm fashioned to repel said pivoting arm from the mid point between its two extreme positions, said resisting means being overcomable by a practicing skier; whereby the practicing skier stands on the platform facing the pivoting arm and pulls the handle means thereof, alternately pivoting the platform and the swing arm, thereby simulating the efforts and body positions associated with slalom waterskiing.

2. A waterski simulator comprising:

(a) a base having a front end and a rear end;

(b) a swing arm assembly pivotally mounted at the front end of the base for limited back and forth rotation between two extreme positions in a horizontal plane, engaged with a flywheel serving to enhance said swing arms momentum in response to effort by a practice skier;

(c) a resisting means extending between one end portion of the swing arm and a fixed point spaced from the arm for repelling motion of the swing arm in its initial movement during a swing toward one extreme position and for providing a pushing force in its later movement during such a swing, said resisting means having two ends connected respectively to the arm and the fixed point by means of pivotal joints to accommodate the swinging movement of the resisting means in response to movement of the swing arm, said resisting means being overcomable by a practicing skier;

(d) handle means flexibly connected to and extending from the swing arm;

(e) a platform mounted in a pivotal mount off the rear end of the base and adapted to pivot thereon between two extreme positions in a horizontal plane, constructed and arranged to hold one practice skier;

whereby a practice skier on the platform may apply effort to the swing arm to impart motion thereto effecting a rotation to its opposite extreme position thereby simulating the positions and efforts associated with slalom-waterskiing.

3. The apparatus of claim 2 wherein the platform is a ski mount.

4. The apparatus of claim 2 wherein the handle means is a ski tow handle.

5. The apparatus of claim 2 wherein the base includes a stationary base and an upwardly extending support.

6. The apparatus of claim 2 wherein the resisting means is a pneumatic cylinder.

7. The apparatus of claim 3 wherein the pivotal ski mount includes rocking means for providing a lateral rocking motion of the practice skier on the mount.

8. The apparatus of claim 7 wherein the rocking means is a roll axle.

9. The apparatus of claim 2 wherein a stop means is included with the pivotal mount such that the pivotal movement of the mount is limited to the two extreme positions and pivoting there between.

10. The apparatus of claim 4 wherein the tow handle means includes a length of to rope.

11. The apparatus of claim 2 wherein a lock means is included and operatively associated with the swing arm and the platform for preventing pivotal movement of the platform during swinging movement of the swing arm between the two extreme positions.

12. The apparatus of claim 5 wherein (a) the base further includes:

(i) a pair of upright side supports extending from the front end region of the base to a central region of the base;

(ii) a pair of side stay braces located proximal to the front end of the base, said side stay braces having proximal and distal ends, the proximal ends thereof extending from the side supports and the distal ends of which are joined to form an inverted V-shaped frame.

(iii) a pair of angle braces extending from the side stay braces to the sides of the base at its central region; and (iv) a mounting member extending between the sides of the base at its rear end region, said mounting member including a pivotal mount adopted to receive a ski mount or the like; and (b) the platform is a ski mount with a top side and an underside, said ski mount having a mounting means receivable in the mounting member, said mounting means being fixed on the underside of the ski mount, the mounting means further including:

(i) a support plate fixed to the underside of the ski mount, (ii) a U-shaped bar carried by the support plate, said U-shaped bar having a base and two arms, one of which extends higher than the other, the arms of the U-shaped bar being fixed to the support plate;

(iii) a horizontal support member attached to the base of said U-shaped bar and extending perpendicularly thereto, (iv) a depending pivot means extending downwardly from the horizontal support member, constructed and arranged to mate with the mounting means of the base;

(v) a lateral pivot means comprising in combination, a roll axle and a roll axle housing fixed to the support plate and extending between the arms of the U-shaped bar; and (vi) a pair of spring members respectively extending from the lower portions of the upright members and connected to the lateral pivoting of the ski mount.

13. The apparatus of claim 12 wherein the swing arm assembly further includes:

(a) a swing shank with a head and a foot, the swing arm assembly being rotated by means of an arcuate rack fixed adjacent the foot of the swing shank, the rack being arranged to mate with a flywheel pinion fixed to said flywheel located on the base;

(b) a swing brace extending from the swing arm to the swing shank; and (c) a swing lever having proximal and distal ends, said swing lever being fixed at its proximal end to the swing shank above the arcuate rack and extending perpendicularly thereto, said swing lever including a clevis at its distal end adapted for attachment to the pneumatic cylinder.

14. The apparatus of claim 11 wherein the lock means is a lock pin assembly including a tubular housing, a pair of plunger assemblies spring loaded therein, a pair of cables, each having proximal and distal ends, the proximal ends being spring loaded into a plunger assembly and the distal ends being attached to oppositely disposed lock release mechanisms activated by the swing arm assembly.

15. The apparatus of claim 14 wherein the lock release mechanism is a caliper brake.

* * * * *